US006830519B2

(12) United States Patent
Reed et al.

(10) Patent No.: US 6,830,519 B2
(45) Date of Patent: Dec. 14, 2004

(54) SET OF IRON TYPE GOLF CLUBS

(75) Inventors: Tim Reed, Allen, TX (US); Michael Vrska, Allen, TX (US); Robert M. Boyd, Lewisville, TX (US); Byron H. Adams, Dallas, TX (US); Oliver G. Brewer, III, Plano, TX (US)

(73) Assignee: Adams Golf IP, LP, Plano, TX (US)

( * ) Notice: Subject to any disclaimer, the term of this patent is extended or adjusted under 35 U.S.C. 154(b) by 0 days.

(21) Appl. No.: 10/420,736

(22) Filed: Apr. 23, 2003

(65) Prior Publication Data

US 2004/0214655 A1 Oct. 28, 2004

(51) Int. Cl.[7] ..... A63B 53/04
(52) U.S. Cl. ..... 473/290; 473/345; 473/350
(58) Field of Search ..... 473/289–291, 473/345, 350

(56) References Cited

U.S. PATENT DOCUMENTS

| | | | | | |
|---|---|---|---|---|---|
| 1,257,471 | A | | 2/1918 | Fitzjohn et al. | |
| 1,642,462 | A | | 9/1927 | Reach | |
| 3,703,824 | A | | 11/1972 | Osborne et al. | 73/65 |
| 3,984,103 | A | * | 10/1976 | Nix | 473/291 |
| 4,498,672 | A | * | 2/1985 | Bulla | 473/332 |
| 4,645,207 | A | * | 2/1987 | Teramoto et al. | 473/290 |
| 4,840,380 | A | * | 6/1989 | Kajita et al. | 473/291 |
| 5,121,918 | A | * | 6/1992 | Teramoto et al. | 473/290 |
| 5,344,140 | A | * | 9/1994 | Anderson | 473/342 |
| 5,549,297 | A | | 8/1996 | Mahaffey | 473/290 |
| 5,599,243 | A | | 2/1997 | Kobayashi | 473/335 |
| D388,142 | S | | 12/1997 | Miller | D21/214 |
| D404,098 | S | | 1/1999 | Ishikawa et al. | D21/733 |
| 6,045,456 | A | * | 4/2000 | Best et al. | 473/291 |
| D426,604 | S | | 6/2000 | Besnard et al. | D21/752 |
| 6,071,198 | A | | 6/2000 | Nishizawa et al. | 473/291 |
| 6,089,990 | A | | 7/2000 | Kimura | 473/290 |
| D438,926 | S | | 3/2001 | Adams et al. | D21/748 |
| 6,206,790 | B1 | | 3/2001 | Kubica et al. | 473/335 |
| 6,319,147 | B1 | | 11/2001 | Nakamura et al. | 473/287 |
| 6,348,010 | B1 | * | 2/2002 | Doolen | 473/290 |
| 6,379,260 | B1 | | 4/2002 | Iwade et al. | 473/290 |
| 6,494,790 | B1 | * | 12/2002 | Toyota et al. | 473/345 |
| 6,533,679 | B1 | * | 3/2003 | McCabe et al. | 473/335 |
| 6,685,577 | B1 | * | 2/2004 | Scruggs et al. | 473/349 |
| 2001/0014628 | A1 | * | 8/2001 | Erickson et al. | 473/334 |

* cited by examiner

*Primary Examiner*—Stephen Blau
(74) *Attorney, Agent, or Firm*—Welsh & Flaxman LLC

(57) ABSTRACT

A correlated set of iron type golf clubs is designed to improve performance. The set of clubs includes a plurality of iron type golf clubs having linearly spaced lofts such that a first iron type golf club has a loft which is x degrees greater than the loft of a second iron type golf club and the second iron type golf club has a loft which is x degrees greater than a third iron type golf club and subsequent iron type golf clubs increase in loft at the same rate. The plurality of iron type golf clubs also have lengths which are linearly spaced such that a first iron type golf club has a length which is y inches less than the length of the second iron type golf club and the second iron type golf club has a length which is y inches less than the length of the third iron type golf club and subsequent iron type golf clubs decrease in length at the same rate. The set of iron type golf clubs is further designed such that the design efficiency increases as the loft of the golf clubs decreases.

18 Claims, 5 Drawing Sheets

*DATA:*

| Brand | Model | Club | Head Weight (g) | Loft(°) | Volume ($cm^3$) | MOIx ($g\ cm^2$) | MOIy ($g\ cm^2$) | Ycg(in) | Zcg(in) | CMA@ 0.700" |
|---|---|---|---|---|---|---|---|---|---|---|
| Callaway | Big Bertha | 3 | 241.1 | 22.0 | 32.6 | 504.0 | 2192.1 | 0.679 | 0.544 | 0.359 |
| Callaway | Big Bertha | 6 | 260.0 | 30.2 | 35.9 | 599.3 | 2227.7 | 0.678 | 0.560 | 0.319 |
| Callaway | Big Bertha | 9 | 280.7 | 41.8 | 37.9 | 638.2 | 2310.5 | 0.603 | 0.669 | 0.362 |
| Adams | Adams Idea | 3 | 226.8 | 17.5 | 123.5 | 980.1 | 2611.7 | 0.654 | 0.491 | 0.805 |
| Adams | Adams Idea | 6 | 255.1 | 28.9 | 52.5 | 700.7 | 2921.7 | 0.774 | 0.539 | 0.278 |
| Adams | Adams Idea | 9 | 285.5 | 41.5 | 38.5 | 663.2 | 2576.1 | 0.682 | 0.467 | 0.204 |
| Mizuno | MP-14 | 3 | 244.5 | 23.1 | 33.5 | 431.3 | 2130.7 | 0.748 | 0.271 | 0.147 |
| Mizuno | MP-14 | 6 | 266.5 | 31.5 | 36.0 | 566.7 | 2415.7 | 0.754 | 0.348 | 0.164 |
| Mizuno | MP-14 | 9 | 286.5 | 44.7 | 38.5 | 721.2 | 2636.9 | 0.724 | 0.463 | 0.150 |
| Cobra | KC SS | 3 | 240.5 | 20.4 | 32.5 | 558.0 | 2313.3 | 0.705 | 0.475 | 0.199 |
| Cobra | KC SS | 6 | 260.5 | 29.6 | 35.2 | 665.2 | 2520.1 | 0.723 | 0.492 | 0.198 |
| Cobra | KC SS | 9 | 283.5 | 41.6 | 38.3 | 940.8 | 2921.1 | 0.689 | 0.543 | 0.192 |
| Wilson | Hybrid FS | 3 | 230.5 | 17.8 | 114.5 | 1075.7 | 3182.7 | 0.808 | 0.661 | 0.635 |
| Wilson | Hybrid FS | 6 | 252.5 | 27.8 | 34.1 | 565.0 | 2407.0 | 0.689 | 0.350 | 0.165 |
| Wilson | Hybrid FS | 9 | 272.8 | 39.7 | 36.8 | 730.6 | 2733.0 | 0.650 | 0.406 | 0.171 |

Table1

FIG. 6

FIG. 7

*RESULTS :*

| Brand | Model | Club | Design Efficiency Number 6 |
|---|---|---|---|
| Callaway | Big Bertha | 3 | 149397 |
| Callaway | Big Bertha | 6 | 184329 |
| Callaway | Big Bertha | 9 | 199092 |
| Adams | Adams Idea | 3 | 1393948 |
| Adams | Adams Idea | 6 | 421288 |
| Adams | Adams Idea | 9 | 230379 |
| Mizuno | MP-14 | 3 | 125925 |
| Mizuno | MP-14 | 6 | 184941 |
| Mizuno | MP-14 | 9 | 255568 |
| Cobra | KC SS | 3 | 174423 |
| Cobra | KC SS | 6 | 226519 |
| Cobra | KC SS | 9 | 371270 |
| Wilson | Hybrid FS | 3 | 1700716 |
| Wilson | Hybrid FS | 6 | 183777 |
| Wilson | Hybrid FS | 9 | 269559 |

Design efficiency Number = (MOIx*MOIy*Volume)/(head Mass)

Table 2

SET OF IRON TYPE GOLF CLUBS

BACKGROUND OF THE INVENTION

1. Field of the Invention

The invention relates to a correlated set of iron type golf clubs. More particularly, the invention relates to a set of iron type golf clubs correlated with linearly spaced lofts and lengths in conjunction with improved design efficiency.

2. Description of the Prior Art

Golf club design has evolved from relatively unforgiving forged blade irons to cast cavity back irons, and then into oversized and even some hollow designs. All of these developments have been made in an effort to improve playability for the average golfer.

Along with these changes, however, golf club manufacturers have decreased club face lofts and increased club lengths. As those familiar with the golf industry will certainly appreciate, these changes have been made in effort to provide golfers with increased distance.

While golfers have gained added length from these longer irons, the manufacture of irons capable of providing longer carries has increased the difficulty of squarely hitting these irons. The increased difficulty brought about by the increases in club lengths has countered the design improvements aimed at enhancing the playability of golf clubs. These difficulties are most pronounced in the longer irons (especially the 3 irons and 4 irons, but including the 5 irons, 6 irons and 7 irons), which are now more difficult to hit despite the addition of various head design enhancements.

The increased lengths of golf clubs, and iron type golf clubs in particular, have also resulted in lighter club heads. Besides the increased length and decreased loft, the center of gravity found in most iron type club heads has generally remained relatively close to the face and the moment of inertia (which provides a direct correlation to the clubs resistance to twisting and therefore off-center-hit performance) has not significantly increased.

Additionally, lofts have not been strengthened uniformly throughout the set; the short iron lofts have been made four to five degrees stronger while the lofts of long irons have been strengthened only one to three degrees, on average. This has resulted in inconsistent and unequal ball carry distances for the average golfer.

In view of the many changes surrounding the recent development of iron type golf clubs, a need exists for a system by which golfers may take advantage of these many improvements while minimizing the inherent shortcomings of these new designs. The present invention provides such a system by offering a correlated set of iron type golf clubs.

SUMMARY OF THE INVENTION

It is, therefore, an object of the present invention to provide a correlated set of iron type golf clubs designed so as to improve performance. The set of clubs includes a plurality of iron type golf clubs having linearly spaced lofts such that a first iron type golf club has a loft which is x degrees greater than the loft of a second iron type golf club and the second iron type golf club has a loft which is x degrees greater than a third iron type golf club and subsequent iron type golf clubs increase in loft at the same rate. The plurality of iron type golf clubs also have lengths which are linearly spaced such that a first iron type golf club has a length which is y inches less than the length of the second iron type golf club and the second iron type golf club has a length which is y inches less than the length of the third iron type golf club and subsequent iron type golf clubs decrease in length at the same rate. The set of iron type golf clubs is further designed such that the design efficiency increases as the loft of the golf clubs decreases, wherein design efficiency is defined as:

$$DE \text{ (design efficiency)} = ((MOIx * MOIy) * (\text{Club Head Volume}))/\text{Club Head Mass}$$

where,

MOIx=moment of inertia around the x-axis

MOIy=moment of inertia around the y-axis.

It is also an object of the present invention to provide a correlated set of iron type golf clubs wherein the loft of the golf clubs is linearly spaced at approximately 4 degrees.

It is a further object of the present invention to provide a correlated set of iron type golf clubs wherein the lengths of the golf clubs are linearly spaced at approximately 0.75 inches.

It is another object of the present invention to provide a correlated set of iron type golf clubs wherein the set of iron type golf clubs includes long irons, middle irons and short irons.

It is also another object of the present invention to provide a correlated set of iron type golf clubs wherein the long irons are of an iron-wood construction.

It is still another object of the present invention to provide a correlated set of iron type golf clubs wherein the middle irons are of a hollow back construction.

It is yet another object of the present invention to provide a correlated set of iron type golf clubs wherein the short irons are of a cavity back construction.

It is also an object of the present invention to provide a correlated set of iron type golf clubs wherein the set of irons includes a 3 iron, 4 iron, 5 iron, 6 iron, 7 iron, 8 iron, 9 iron and pitching wedge, and the 3 iron and 4 iron are of an iron-wood construction, the 5 iron, 6 iron and 7 iron are of a hollow back construction and the 8 iron, 9 iron and pitching wedge are of a cavity back construction.

It is a further object of the present invention to provide a correlated set of iron type golf clubs designed so as to improve performance. The set of clubs includes at least three iron type golf clubs, wherein the first iron type golf club has a volume of approximately 85 cc to approximately 140 cc, the second iron type golf club has a volume of approximately 45 cc to approximately 85 cc, and the third iron type club having a volume of approximately 10 cc to approximately 45 cc.

It is also an object of the present invention to provide a correlated set of iron type golf clubs wherein the set of irons includes a 3 iron, 4 iron, 5 iron, 6 iron, 7 iron, 8 iron, 9 iron and pitching wedge, and the 3 iron and 4 iron are of an iron-wood construction having a volume of approximately 85 cc to approximately 140 cc, the 5 iron, 6 iron and 7 iron are of a half hollow construction having a volume of approximately 45 cc to 85 cc and the 8 iron, 9 iron and pitching wedge are of a cavity back construction having a volume of approximately 10 cc to 45 cc.

It is another object of the present invention to provide a correlated set of iron type golf clubs wherein the 3 iron and the 4 iron have a loft range between approximately 15° and approximately 30°, a length range between approximately 37.5 inches and approximately 42 inches and a head mass between approximately 150 grams and approximately 260 grams; the 5 iron, 6 iron and 7 iron have a loft range between approximately 25° and approximately 40°, a length range between approximately 36 inches and approximately 39 inches and a head mass between approximately 200 grams and approximately 300 grams; and the 8 iron, 9 iron and pitching wedge have a loft range between approximately 35° and approximately 50°, a length range between approximately 33 inches and approximately 37.5 inches and a head mass between approximately 150 grams and approximately 260 grams.

Other objects and advantages of the present invention will become apparent from the following detailed description when viewed in conjunction with the accompanying drawings, which set forth certain embodiments of the invention

BRIEF DESCRIPTION OF THE DRAWINGS

FIGS. 6 and 7 are tables outlining implementation of the present invention as compared with currently available set of iron type golf clubs.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
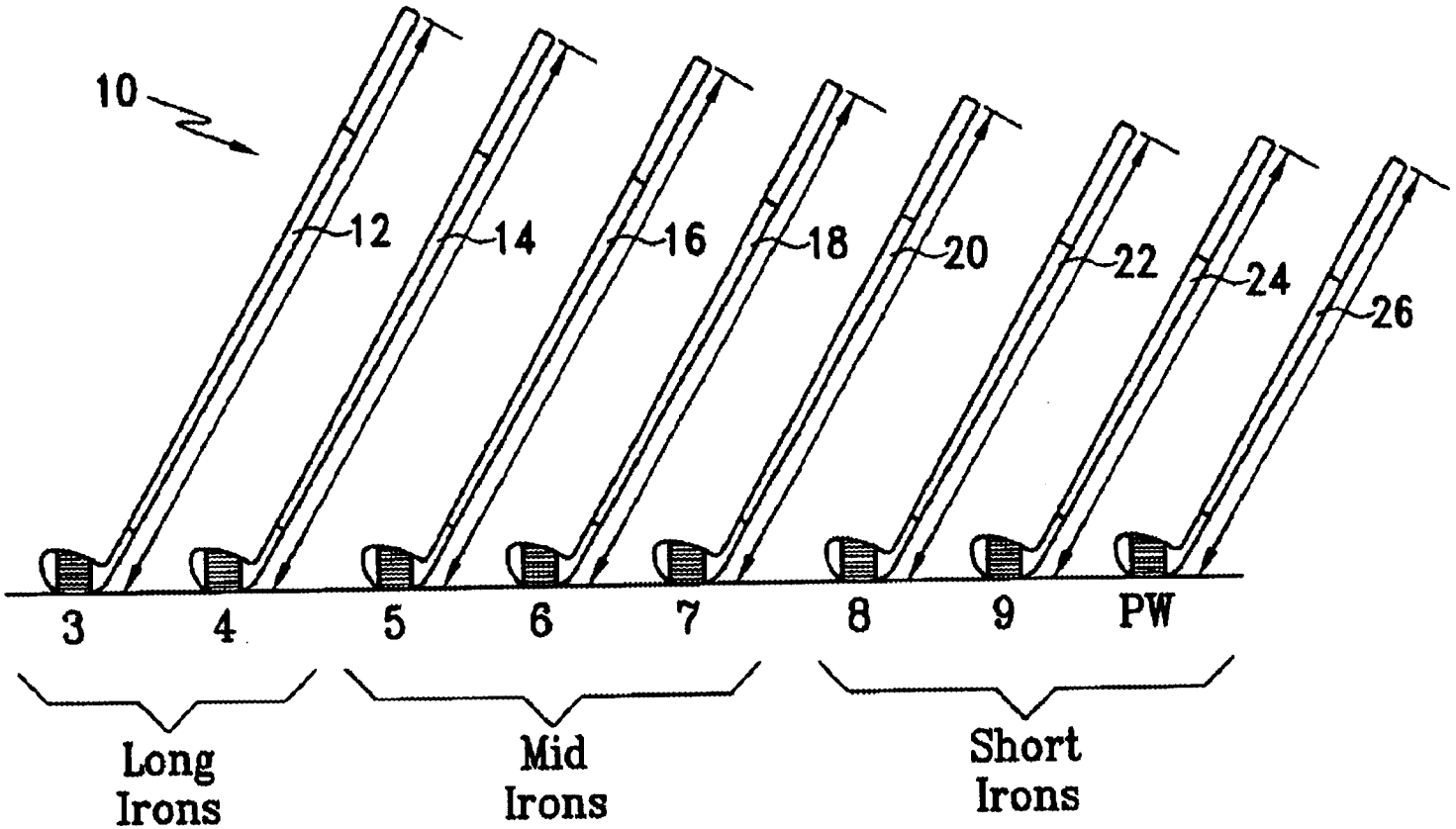
FIG. 1 is a perspective view of the present set of iron type golf clubs.

Referring to FIG. 1, a correlated set of iron type golf clubs 10 in accordance with the present invention is disclosed. The correlated set 10 is designed so as to improve performance by taking advantage of design features offered by differing club constructions. As will be described below in greater detail, the correlated set of iron type golf clubs in accordance with the present invention is designed such that the club lengths and the club lofts of the clubs making up the set are linearly spaced on a straight line slope. In practice, and as those skilled in the art will certainly appreciate based upon their understanding of iron design and usage, the iron type golf clubs making up the present correlated set of iron type golf clubs will provide for lofts ranging from approximately 15° to approximately 50° and have lengths ranging between approximately 33 inches and approximately 42 inches.

Generally, the set of clubs includes a plurality of iron type golf clubs 12, 14, 16, 18, 20, 22, 24, 26. The plurality of iron type golf clubs have lineary spaced lofts such that, for example, with a set of golf clubs consisting of only three iron type golf clubs, a first iron type golf club has a loft which is x degrees greater than the loft of a second iron type golf club and the second iron type golf club has a loft which is x degrees greater than the loft of a third iron type golf club. In accordance with a preferred embodiment of the present invention, the lofts of the various clubs making up the present set of clubs 10 will increase at a rate of approximately 4 degrees as one moves from the 3 iron 12 to the pitching wedge 26.

In addition to providing a set of golf clubs 10 which offer linearly spaced lofts, the present set of clubs 10 has lengths which are linearly spaced such that, for example with a set of golf clubs consisting of only three iron type golf clubs, the first iron type golf club has a length which is y inches less than the length of the second iron type golf club and the second iron type golf club has a length which is y inches less than the length of the third iron type golf club. In accordance with a preferred embodiment of the present invention, the lengths of the various clubs making up the present set of clubs will decrease at a rate of approximately 0.75 inches as one moves from the 3 iron 12 to the pitching wedge 26.

In accordance with a preferred embodiment of the present invention, a set of golf clubs 10 will include a 3 iron 12, 4 iron 14, 5 iron 16, 6 iron 18, 7 iron 20, 8 iron 22, 9 iron 24 and pitching wedge 26. For the purpose of the present disclosure, and for the purpose of claiming the present invention, it should be understood that those skilled in the art will understand the 3 and 4 irons 12, 14 to be "long irons", the 5, 6 and 7 irons 16, 18, 20 to be "middle irons" and the 8 iron 22, 9 iron 24 and pitching wedge 26 to be "short irons".

In addition to providing for linear adjustment of both the club loft and the club length, the present set of golf clubs 10 is designed such that design efficiency increases as the loft of the golf clubs decreases. In accordance with the present invention, design efficiency is defined as:

$$DE(\text{design efficiency})=(MOLx*MOIy)*(\text{Club Head Volume}))/\text{Club Head Mass}$$

where,

MOIx=moment of inertia around the x-axis; and

MOIy=moment of inertia around the y-axis; and those skilled in the art will appreciate that the moment of inertia for a club head relates to its resistance to twisting about a particular axis.

By increasing design efficiency as the loft of the clubs decreases, the present set of clubs 10 is able to increase performance, which may be quantified in terms of distance and accuracy. First, distance is added by increasing the length slope between clubs. In addition, the long irons' head weights are made lighter, thereby challenging accuracy. Further, by using less available head mass the present set is able to obtained higher MOIx and MOIy while increasing the volume of the head. All of these adjustments lead to better design efficiency as defined above. In accordance with the present invention, each club is individually designed, within specific loft and length constraints, to specific launch conditions so as to restore proper gapping between clubs.

The club features discussed above were specifically chosen to make the long irons, middle irons, and even short irons easier to hit. The implementation of design efficiency, in conjunction with a linear loft and length adjustment, is achieved through head design and the placement of the center of gravity. The head design of the club heads utilized in accordance with the present invention is determined by varying the shape, mass, and volume of the club heads. With regard to the placement of the center of gravity, proper positioning is achieved by varying the MOIx and MOIy.

When implementation of the present invention is compared with current and prior sets of iron type golf clubs, it becomes apparent that some irons have higher inertia, but with a center of gravity or head weight trade-off. In addition, some popular irons have a deeper center of gravity, but suffer in the moment of inertia area. The present invention optimizes all aspects of head design by creating an optimum correlated set of irons.

Figure 2:
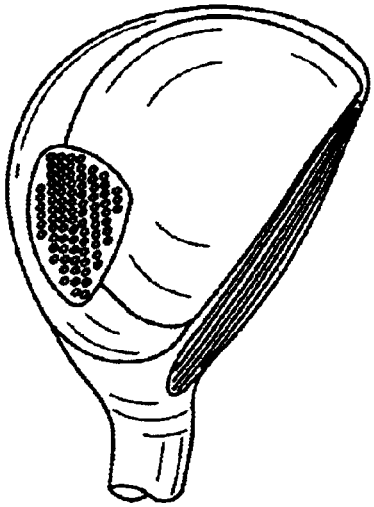
FIG. 2 is a rear view of an exemplary iron-wood construction utilized in accordance with the present invention.
Figure 3:
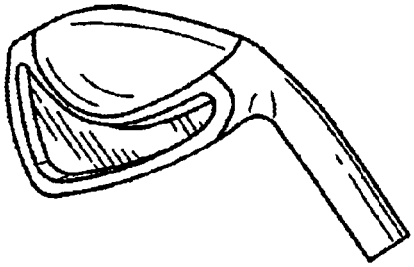
FIG. 3 is a rear view of an exemplary hollow back construction utilized in accordance with the present invention.
Figure 4:
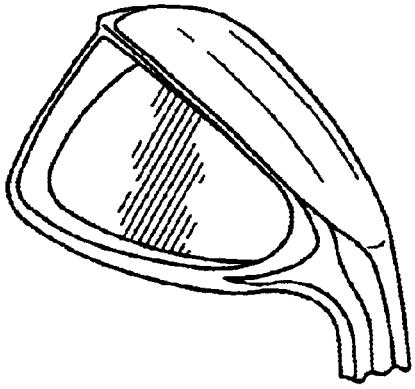
FIG. 4 is a rear view of an exemplary cavity back construction utilized in accordance with the present invention.

In accordance with a preferred embodiment of the present invention, increased design efficiency is combined with linear loft and length changes by providing a set of iron type golf clubs 10 in which the 3 iron 12 and 4 iron 14 are of an iron-wood construction (see FIG. 2), the 5 iron 16, 6 iron 18 and 7 iron 20 are of a half hollow, or hollow back, construction (see FIG. 3) and the 8 iron 22, 9 iron 24 and pitching wedge 26 are of a cavity back construction (see FIG. 4). Through the utilization of different club head constructions within the same set of golf clubs 10, the present system is able to optimize MOIx, MOIy, Volume and Mass so as to improve design efficiency for those clubs which are most difficult to hit With regard to the iron-wood construction utilized in conjunction with the 3 and 4 irons 12, 14, and with reference to FIG. 2, an iron-wood construction is considered to refer to a hybrid type club head adopting characteristics of both iron type club heads and wood type club heads. Specifically, iron-woods, or hybrids, deliver the distance of a fairway wood with the control and accuracy of an iron. This is achieved by positioning a mass body behind the striking face of the club head. In particular, iron-woods are designed to help golfers get the ball airborne quickly and effortlessly with pinpoint accuracy toward the target. The mass of the compact club head offers the distance of a fairway wood, with easier playability and control than a long iron. The center of gravity of iron-woods is generally lower and further back than an iron. This creates a higher trajectory and softer landing shot than an iron of comparable loft, without sacrificing distance. Examples of iron-woods are found in U.S. Pat. No. 1,257,471 to Fitzjohn & Stanton, D426,604 to Besnard et al., D404,098 to Ishikawa et al., D388142 to Miller, which are incorporated herein by reference.

In view of the requirements set forth above for improvement in design efficiency, long irons, as utilized in accordance with the present invention, are constructed with a loft range between approximately 15° and approximately 30°. These long irons will also have a length range between approximately 37.5 inches and approximately 42 inches, as well as a volume range between approximately 85 cc and approximately 140 cc. Finally, long irons in accordance with a preferred embodiment of the present are constructed with a head mass between approximately 150 grams and approximately 260 grams.

With regard to the hollow back construction utilized in conjunction with the 5, 6 and 7 irons 16, 18, 20, and with reference to FIG. 3, these irons include a hollow cavity directly behind the striking face of the club head. The hollow cavity is defined by a shell that extends from the rear of the club head to create an enclosed hollow space directly behind the striking face. Hollow back irons are generally disclosed in U.S. Pat. No. 5,184,823 to Desboilles et al., U.S. Pat. No. 5,344,140 to Anderson and U.S. Pat. No. 6,206,790 to Kubica et al., which are incorporated herein by reference, and provide examples of such hollow back irons.

In view of the requirements set forth above for improvement in design efficiency, middle irons as utilized in accordance with the present invention are constructed with a loft range between approximately 25° and approximately 40° These middle irons will also have a length range between approximately 36 inches and approximately 39 inches, as well as a volume range between approximately45 cc and approximately 85 cc. Finally, middle irons in accordance with a preferred embodiment of the present are constructed with a head mass between approximately 200 grams and approximately 300 grams.

With regard to the cavity back construction utilized in conjunction with the 8 iron 22, 9 iron 24 and pitching wedge 26, and with reference to FIG. 4, those of skill in the golf art will understand this to refer to an iron type club head in which the weight is distributed toward the perimeter of the head. Cavity backs are easily identified as having a recessed area on the back of the head and U.S. Pat. No. 6,045,456 to Best et al., U.S. Pat. No. 5,599,243 to Kobayashi, U.S. Pat. No. 5,549,297 to Mahaffey and D438,926 to Adams et al., which are incorporated herein by reference, provide examples of such cavity back irons.

In view of the requirements set forth above for improvement in design efficiency, short irons as utilized in accordance with the present invention are constructed with a loft range between approximately 35° and approximately 50°. These short irons will also have a length range between approximately 33 inches and approximately 37.5 inches, as well as a volume range between approximately 10 cc and approximately 45 cc. Finally, short irons in accordance with a preferred embodiment of the present are constructed with a head mass between approximately 150 grams and approximately 260 grams.

Figure 5:
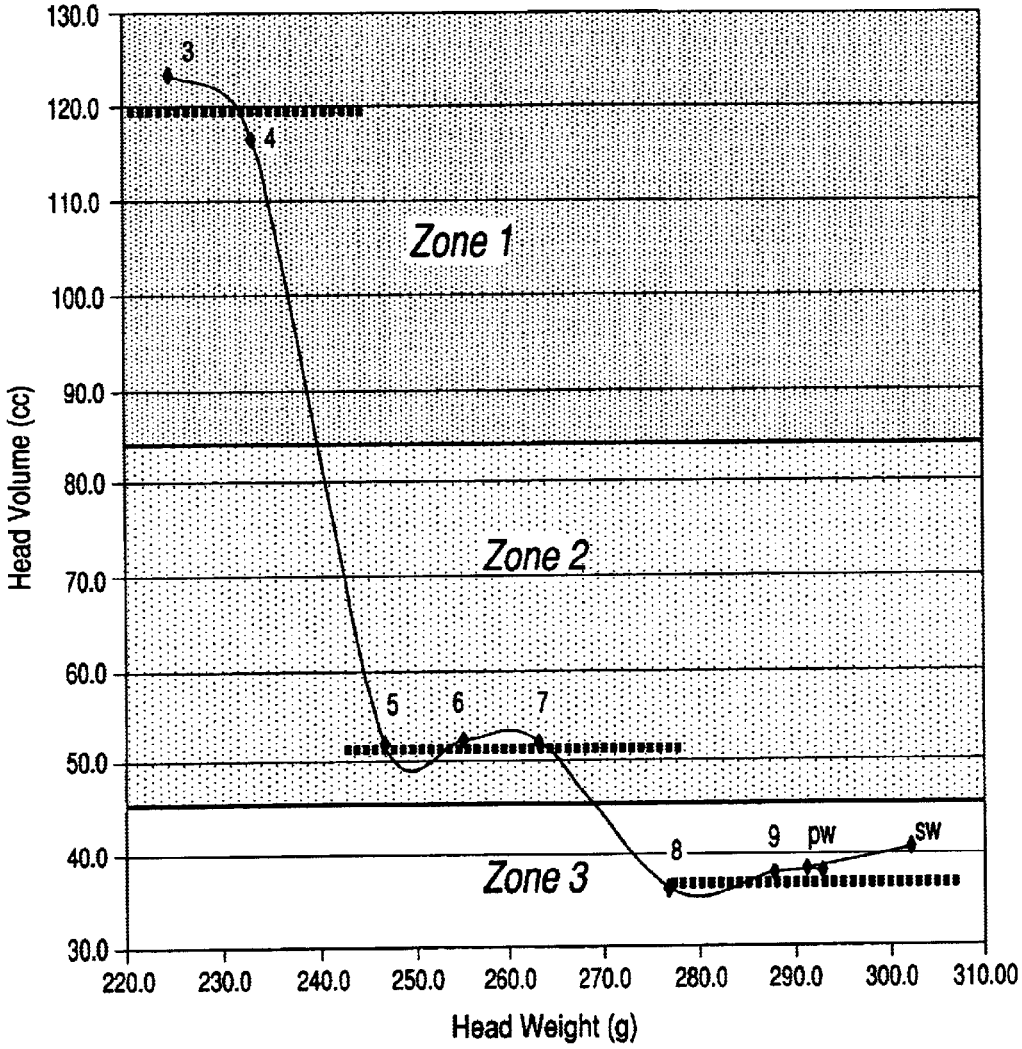
FIG. 5 is a graph relating volume v. weight as it concerns the present correlated set of golf clubs.

As mentioned above, the present correlated set of clubs provides three distinct club head constructions within a single set of golf clubs. The relationship between the club head volumes and the club head weights is set forth in FIG. 5. The relationship exhibited by the different types of irons utilized in the accordance the present invention is utilized in optimizing the set of clubs based upon the specific purpose of the iron type golf club being used. For example, by increasing the volume of the long irons in conjunction with a relatively low weight, the long irons are easier to get up in the air with greater accuracy. In addition, these long irons provide greater distance and more forgiving striking face than traditional long irons. With regard to the middle irons, the use of a hollow back construction provides for a moderate volume increase, while still maintaining the head weight in a desirable range. This construction allows for the movement of weight lower and backward, providing mom forgiveness than a traditional middle iron. As to the short irons, control is desired and this is provided through the utilization of an oversized head with a traditional cavity back construction FIGS. 6 and 7 outline implementation of the present invention as compared with currently available set of iron type golf clubs.

While the preferred embodiments have been shown and described, it will be understood that there is no intent to limit the invention by such disclosure, but rather, is intended to cover all modifications and alternate constructions failing within the spirit and scope of the invention as defined in the appended claims.

What is claimed is:

1. A correlated set of iron type golf clubs designed so as to improve performance, the set of clubs comprising:

a plurality of iron type golf clubs having first iron type golf club heads, the first iron type golf club heads having volumes of approximately 85 cc to approximately 140 cc and loft ranges between approximately 15° and approximately 30°;

a plurality of iron type golf clubs having second iron type golf club heads, the second iron type golf club heads having volumes of approximately 45 cc to approximately 85 cc and loft ranges between approximately 25 and approximately 40; and a plurality of iron type golf clubs having third iron type golf club heads, the third iron type golf club heads having a volumes of approximately 10 cc to approximately45 cc and loft ranges between approximately 35° and approximately 50°.

2. The correlated set of iron type club heads according to claim 1, wherein the plurality of iron type golf clubs have linearly spaced lofts such that a first iron club has a loft which is x degrees greater than the loft of a second iron club and the second iron club has a loft which is x degrees greater than the loft of a second iron club and subsequent iron clubs increase in loft at the same rate, and the plurality of iron type golf clubs have lengths which are linearly spaced such that the first iron club has a length which is y inches less than the length of the second iron club and the second iron club has a length which is y inches less than length of the third iron club and subsequent iron clubs decrease length at the same rate.

3. The correlated set of iron type golf clubs according to claim 2, wherein the lengths of the plurality of iron type golf clubs are linearly spaced at approximately 0.75 inches.

4. The correlated set of iron type club heads according to claim 1, wherein the set of irons includes a 3 iron, 4 iron, 5 iron, 6 iron, 7 iron, 8 iron, 9 iron and pitching wedge, and the plurality of iron type golf clubs having first iron type golf club heads are composed of the 3 iron and 4 iron that are of an iron-wood construction having a volume of approximately 85 cc to approximately 140 cc, the plurality of iron type golf clubs having second iron type golf club heads are composed of the 5 iron, 6 iron and 7 iron that are of a half hollow construction having a volume of approximately 45 cc to 85 cc and the plurality of iron type golf clubs having third iron type golf club heads are composed of the 8 iron, 9 iron and pitching wedge that are of a cavity back construction having a volume of approximately 10 cc to 45 cc.

5. The correlated set of iron type golf clubs according to claim 4, wherein the 3 iron and the 4 iron have a loft range between approximately 15° and approximately 30°, a length range between approximately 37.5 inches and approximately 42 inches and a head mass between approximately 150 grams and approximately 260 grams;

the 5 iron, 6 iron and 7 iron have a loft range between approximately 25° and approximately 40°, a length range between approximately 36 inches and approximately 39 inches and a head mass between approximately 200 grams and approximately 300 grams; and the 8 iron, 9 iron and pitching wedge have a loft range between approximately 35° and approximately 50°, a length range between approximately 33 inches and approximately 37.5 inches and a head mass between approximately 150 grams and approximately 260 grams.

6. The correlated set of iron type golf clubs according to claim 1, wherein the plurality of iron type golf clubs having first iron type golf club heads have a loft range between approximately 15° and approximately 30°, a length range between approximately 37.5 inches and approximately 42 inches and a head mass between approximately 150 grams and approximately 260 grams;

the plurality of iron type golf clubs having second iron type golf club heads have a loft range between approximately 25° and approximately 40°, a length range between approximately 36 inches and approximately 39 inches and a head mass between approximately 200 grams and approximately 300 grams; and the plurality of iron type golf clubs having third iron type club golf heads have a loft range between approximately 35° and approximately 50°, a length range between approximately 33 inches and approximately 37.5 inches and a head mass between approximately 150 grams and approximately 260 grams.

7. The correlated set of iron type golf clubs according to claim 1, wherein the plurality of iron type golf clubs having first iron type golf club heads have an iron-wood construction, the plurality of iron type golf clubs having second iron type golf club heads have a half hollow construction and the plurality of iron type golf clubs having third iron type golf club heads have a cavity back construction.

8. A correlated set of iron type golf clubs designed so as to improve performance, the set of clubs comprising:

a plurality of iron type golf clubs composed of at least one first iron type golf club having a first iron type golf club head, at least one second iron type golf club having a second iron type golf club head, at least one third iron type golf club having a third iron type golf club head;

the first iron type golf club head having a volume of approximately 85 cc to approximately 140 cc;

the second iron type golf club head having a volume of approximately 45 cc to approximately 85 cc; and the third iron type golf club head having a volume of approximately 10 cc to approximately 45 cc;

wherein the plurality of inn type golf clubs have linearly spaced lofts such that the first iron type golf club head has a loft which is x degrees greater than the loft of the second iron type golf club head and the second iron type golf club head has a loft which is x degrees greater than the loft of the third iron type golf club head and subsequent iron type golf club heads increase in loft at the same rate, and the plurality of iron type golf clubs having lengths which are linearly spaced such that the first iron type golf club has a length which is y inches less than the length of the second iron type golf club and the second iron type golf club has a length which is y inches less than length of the third iron type golf club and subsequent iron type golf clubs decrease in length at the same rate.

9. The correlated set of iron type golf clubs according to claim 8, wherein the lengths of the plurality of iron type golf clubs are linearly spaced at approximately 0.75 inches.

10. The correlated set of iron type club heads according to claim 8, wherein the set of irons includes a 3 iron, 4 iron, 5 iron, 6 iron, 7 iron, 8 iron, 9 iron and pitching wedge, and the 3 iron and 4 iron are of an iron-wood construction having a volume of approximately 85 cc to approximately 140 cc, the 5 iron, 6 iron and 7 iron are of a half hollow construction having a volume of approximately 45 cc to 85 cc and the 8 iron, 9 iron and pitching wedge are of a cavity back construction having a volume of approximately 10 cc to 45 cc.

11. The correlated set of iron type golf clubs according to claim 10, wherein the 3 iron and the 4 iron have a loft range between approximately 15° and approximately 30°, a length range between approximately 37.5 inches and approximately 42 inches and a head mass between approximately 150 grams and approximately 260 grams;

the 5 iron, 6 iron and 7 iron have a loft range between approximately 25° and approximately 40°, a length range between approximately 36 inches and approximately 39 inches and a head mass between approximately 200 grams and approximately 300 grams; and the 8 iron, 9 iron and pitching wedge have a loft range between approximately 350 and approximately 50°, a length range between approximately 33 inches and approximately 37.5 inches and a head mass between approximately 150 grams and approximately 260 grams.

12. The correlated set of iron type golf clubs according to claim 8, wherein the first iron type golf club has a loft range between approximately 15° and approximately 30°, a length range between approximately 37.5 inches and approximately 42 inches and a head mass between approximately 150 grams and approximately 260 grams;

the second iron type golf club has a loft range between approximately 25° and approximately 40°, a length range between approximately 36 inches and approximately 39 inches and a head mass between approximately 200 grams and approximately 300 grams; and the third iron type golf club has a loft range between approximately 350 and approximately 50°, a length range between approximately 33 inches and approximately 37.5 inches and a head mass between approximately 150 grams and approximately 260 grams.

13. The correlated set of iron type golf clubs according to claim 12, wherein the first iron type golf club head has an iron-wood construction, the second iron type golf club head has a half hollow construction and the third iron type golf club head has a cavity back construction.

14. A correlated set of iron type golf clubs designed so as to improve performance, the set of clubs comprising:

a plurality of first iron type golf clubs having first iron type golf club heads wherein the first iron type golf clubs include a 3 iron and a 4 iron, a plurality of second iron type golf clubs having a second iron type golf club heads wherein the second iron type golf clubs include a 5 iron, 6 iron and 7 iron, and a plurality of third iron type golf clubs having third iron type golf club heads wherein the third iron type golf clubs include an 8 iron, 9 iron and pitching wedge;

the first iron type golf club heads are of an iron-wood construction having a volume of approximately 85 cc to approximately 140 cc;

the second iron type golf club heads are of a half hollow construction having a volume of approximately 45 cc to approximately 85 cc; and the third iron type golf club heads are of a cavity back construction having a volume of approximately 10 cc to approximately 45 cc.

15. The correlated set of iron type golf clubs according to claim 14, wherein the 3 iron and the 4 iron have a loft range between approximately 15° and approximately 30°, a length range between approximately 37.5 inches and approximately 42 inches and a head mass between approximately 150 grams and approximately 260 grams;

the 5 iron, 6 iron and 7 iron have a loft range between approximately 250 and approximately 40°, a length range between approximately 36 inches and approximately 39 inches and a head mass between approximately 200 grams and approximately 300 grams; and the 8 iron, 9 iron and pitching wedge have a loft range between approximately 35° and approximately 50°, a length range between approximately 33 inches and approximately 37.5 inches and a head mass between approximately 150 grams and approximately 260 grams.

16. The correlated set of iron type golf clubs according to claim 14, wherein the first iron type golf clubs have a loft range between approximately 150 and approximately 30°, a length range between approximately 375 inches and approximately 42 inches and a head mass between approximately 150 grams and approximately 260 grams;

the second iron type golf clubs have a loft range between approximately 25° and approximately 40°, a length range between approximately 36 inches and approximately 39 inches and a head mass between approximately 200 grams and approximately 300 grams; and the third iron type golf clubs have a loft range between approximately 35° and approximately 50°, a length range between approximately 33 inches and approximately 37.5 inches and a head mass between approximately 150 grams and approximately 260 grams.

17. The correlated set of iron type golf clubs according to claim 14, wherein the first iron type golf club heads havs an iron-wood construction, the second iron type golf club heads have a half hollow construction and the third iron type golf club heads have a cavity back construction.

18. A correlated set of iron type golf clubs designed so as to improve performance, the set of clubs comprising:

a plurality of iron type golf clubs composed of at least one first iron type golf club having a first iron type golf club head, at least one second iron type golf club having a second iron type golf club head, at least one third iron type golf club having a third type golf club head;

the first iron golf club having a head volume of approximately 45 cc to approximately 85 cc, a loft range between 15° and approximately 30°, a length range between 37.5 inches and approximately 42 inches and a head mass between approximately 150 grams and approximately 260 grams;

the second iron type golf club having a head volume of approximately 45 cc to approximately 85 cc, a loft range between approximately 25° and approximately 40°, a length range between approximately 36 inches and approximately 39 inches and a head mass between approximately 200 grams and approximately 300 grams; and the third iron type golf club having a head volume of approximately 10 cc to approximately 45 cc, a loft range between approximately 35° and approximately 50°, a length range between approximately 33 inches and approximately 37.5 inches and a head mass between approximately 150 grams and approximately 260 grams.

* * * * *